United States Patent [19]

Yu

[11] Patent Number: 4,943,508

[45] Date of Patent: Jul. 24, 1990

[54] METHOD OF FABRICATING A LAYERED FLEXIBLE ELECTROPHOTOGRAPHIC IMAGING MEMBER

[75] Inventor: Robert C. U. Yu, Webster, N.Y.

[73] Assignee: Xerox Corporation, Stamford, Conn.

[21] Appl. No.: 375,423

[22] Filed: Jul. 3, 1989

[51] Int. Cl.[5] ..... G03G 5/04; G03G 5/14

[52] U.S. Cl. ..... 430/129; 430/131; 430/58; 430/134

[58] Field of Search ..... 430/129, 127, 131, 134

[56] References Cited

U.S. PATENT DOCUMENTS 3,973,961 8/1976 Ströszynski ..... 430/129

*Primary Examiner*—J. David Welsh

[57] ABSTRACT

A process for fabricating an electrophotographic imaging member is disclosed which involves providing an electrically conductive layer, forming an aminosilane reaction product charge blocking layer on the electrically conductive layer, extruding a ribbon of a solution comprising an adhesive polymer dissolved in at least a first solvent on the electrically conductive layer to form a wet adhesive layer, drying the adhesive layer to form a dry continuous coating having a thickness between about 0.08 micrometer (800 angstroms) and about 0.3 micrometer (3,000 angstroms), applying to the dry continuous coating a mixture comprising charge generating particles dispersed in a solution of a binder polymer dissolved in at least a second solvent to form a wet generating layer, the binder polymer being miscible with the adhesive polymer, drying the wet generating layer to remove substantially all of the second solvent, and applying a charge transport layer, the adhesive polymer consisting essentially of a linear saturated copolyester reaction product of ethylene glycol and four diacids wherein the diol is ethylene glycol, the diacids are terephthalic acid, isophthalic acid, adipic acid and azelaic acid, the mole ratio of the terephthalic acid to the isophthalic acid to the adipic acid to the azelaic acid is between about 3.5 and about 4.5 for terephthalic acid: between about 3.5 and about 4.5 for isophthalic acid: between about 0.5 and about 1.5 for adipic acid: between about 0.5 and about 1.5 for azelaic acid, the total moles of diacid being in a mole ratio of diacid to ethylene glycol in the copolyester of 1:1, and the $T_g$ of the copolyester resin being between about 32° C. about 50° C.

20 Claims, 2 Drawing Sheets

METHOD OF FABRICATING A LAYERED FLEXIBLE ELECTROPHOTOGRAPHIC IMAGING MEMBER

BACKGROUND OF THE INVENTION

This invention relates in general to electrophotography and more specifically, to a process for fabricating an electrophotographic imaging member.

In the art of electrophotography an electrophotograph plate comprising a photoconductive insulating layer on a conductive layer a imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a hole blocking layer, an adhesive layer, a charge generating layer, and a charge transport layer. This photoreceptor may also comprise additional layers such as an anti-curl backing layer and an overcoating layer. Although excellent toner images may be obtained with multilayered belt photoreceptors, it has been found that the numerous layers limit the versatility of the multilayered belt photoreceptor. For example, there is a great need for long service life flexible photoreceptors in compact imaging machines that employ small diameter support rollers for photoreceptors belt systems fitted into a very confined space. Small diameter support rollers are also highly desirable for simple, reliable copy paper stripping systems which utilize the beam strength of the copy paper to automatically remove copy paper sheets from the surface of a photoreceptor belt after toner image transfer. Unfortunately, small diameter rollers, e.g., less than about 0.75 inch (19 mm) diameter, raise the threshold of mechanical performance criteria to such a high level that spontaneous photoreceptor belt material failure becomes a frequent event for multilayered belt photoreceptors. Thus, in advanced imaging systems utilizing multilayered belt photoreceptors, cracking has been encountered in one or more critical photoreceptor layers during belt cycling over small diameter rollers. Cracks developed in charge transport layers during cycling were manifested as print-out defects which adversely affected copy quality. Frequent photoreceptor cracking has a serious impact on the versatility of a photoreceptor and reduces its practical value for automatic electrophotographic copiers, duplicators and printers.

Moreover, seams in some multilayered belt photoreceptors can delaminate during fabrication when larger webs are slit into smaller belt size sheets. Further, after the sheets are welded into belts, the belts tend to delaminate during extended cycling over small diameter support rollers or when subjected to lateral forces caused by rubbing contact with stationary web edge guides during cycling. Seam delamination is further aggravated when the belt is employed in electrophotographic imaging system utilizing blade cleaning devices. In addition, belt delamination is encountered during web slitting operations to fabricate belt photoreceptors from wide webs. Alteration of materials in the various belt layers such as the conductive layer, hole blocking layer, adhesive layer, charge generating layer, and/or the charge transport layer to reduce delamination is not easily effected because the new materials may adversely affect the overall electrical, mechanical an other properties of the belt such as residual voltage, background, dark decay, flexibility and the like.

Photoreceptors having charge generating layers and charge transport layers containing small molecule diamine compounds are well known in the art. Similarly, photoreceptors utilizing polyester adhesive layers between a blocking layer and a charge generation layer are also known.

INFORMATION DISCLOSURE STATEMENT

U.S. Pat. No. 4,786,570 to Yu et al, issued on Nov. 22, 1988—A flexible electrophotographic imaging member is disclosed comprising a flexible substrate having an electrically conductive surface, a hole blocking layer comprising an aminosilane reaction product, an adhesive layer having a thickness between about 200 angstroms and about 900 angstroms consisting essentially of at least one copolyester resin having the following formula:

$$\overset{O}{\overset{\|}{HOC}}\text{-[diacid-diol]}_n\text{-OH}$$

wherein the diacid is selected from the group consisting of terephthalic acid, isophthalic acid, and mixtures thereof, the diol comprises ethylene glycol, the mole ratio of diacid to diol is 1:1, n is a number between about 175 and about 350 and the $T_g$ of the copolyester resin is between about 30° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer. Processes for fabricating and using the flexible electrophotographic imaging member are also disclosed. The charge generating and charge transport layers may be applied by extrusion coating. Moreover, adhesive layers are described which contain du Pont 49000, a copolyester reaction product of ethylene glycol with terephthalic acid, isophthalic acid, adipic acid and azelaic acid.

U.S. Pat. No. 4,415,639 to Horgan, issued Nov. 15, 1983, A photoresponsive device for electrophotography is disclosed. An adhesive layer including various polymers such as polyesters is mentioned, the layer having a thickness of less than about 0.3 micron. DuPont 49K adhesive material is mentioned, for example in line 37, column 10 and in numerous Examples where the adhesive materials are applied, for example, with a Bird applicator. Overcoated on the adhesive layer is a photogenerating layer containing 45 volume percent polyvinyl carbazole. The photogenerating layer was applied as a solution containing Tetrahydrofuran/Toluene as a solvent. The photogenerating layer was then overcoated with a charge transport layer.

U.S. Pat. No. 4,521,457 to Russell et al, issued Jun. 4, 1985—An extrusion coating process and apparatus are disclosed in which at least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member.

U.S. Pat. No. 4,584,253 to Lin et al, issued Apr. 22, 1986—Various electrophotographic imaging members are disclosed including a multilayered imaging member having, between a blocking layer (e.g. a film of siloxane and hydroxypropyl cellulose) and a charge generating layer, an adhesive layer which includes film-forming polymers such as polyester PE-100, du Pont 49,000 resin and other resins (e.g. see column 8, lines 31–41 and column 17, lines 8–18). This adhesive layer has a thickness between about 0.1 micron (1,000 angstroms and about 5 microns (50,000 angstroms). The adhesive layer may be applied with a Bird applicator.

U.S. Pat. No. 4,150,987 to Anderson et al, issued Apr. 24, 1979—Various electrophotographic imaging members are disclosed including, for example, a multilayered imaging member comprising an aluminized Mylar support, a polyester layer such as PE-200, PE-222, PE-207, VPE-5545, PE-307 and 49000 on the aluminum layer, a charge generating layer, and a hydrazone charge transport layer. The polyester adhesive layer is applied as a solution containing 10 percent by weight solids.

U.S. Pat. No. 4,381,337 to Chang, issued Apr. 26, 1983—Various electrophotographic imaging members are disclosed including a multilayered imaging member comprising an electroconductive layer, a charge generating layer, and a charge transport layer wherein a mixture of a polyester having a $T_g$ larger than about 60° C. with a polyester having a $T_g$ smaller than about 30° C. is employed in an adhesive layer on the electroconductive support and in the charge transporting layer numerous specific polyester resins are listed in the paragraph bridging columns 2 and 3, including Vitel PE-200, Vitel PE-100, PE-307 and PE-5571A.

U.S. Pat. No. 4,173,472 to Berwick et al, issued Nov. 6, 1979—Various electrophotographic imaging members are disclosed including a multilayered imaging member having, between an electrically conducting layer and a photoconductive layer, a polyester interlayer (e.g. see column 2, line 34 to column 3, line 2). The polyester can be derived from at least one aromatic dicarboxylic acid and at least one diol. At least one of the aromatic dicarboxylic acids can be an isophthalic acid and the diol can be a branched-chain alkylene diol. The polyester can be derived from mixture of two different acids or or two different diols A barrier layer can be employed between the conductive layer and the interlayer (e.g. see column 7, lines 20–41). The interlayer typically has a dry thickness of from about 0.1 to about 0.5 microns (1,000 to 5,000 angstroms). In Example 6, a copolyester of terephthalic acid, isophthalic acid and ethylene glycol is employed as an interlayer in a photoreceptor.

U.S. Pat. No. 4,588,667 to Jones, issed May 13, 1986—Various overcoated electrophotographic imaging members are disclosed including a multilayered imaging member having a substrate, a titanium metal layer, a siloxane blocking layer, an adhesive layer, a charge generating binder layer, and a charge transport layer. An intermediate layer between the blocking layer and a generator layer may contain a polyester and have a dry thickness of between about 0.1 micron (1,000 angstroms) and about 5 microns (50,000 angstroms). A polyester du Pont 49000 intermediate layer having a thickness of about 0.05 micrometer (500 angstroms) is described in the working examples. The transport layer may contain from about 25 to about 75 percent by weight of a diamine transport material.

U.S. Pat. No. 4,464,450 to Teuscher, issued Aug. 7, 1984—Various overcoated electrophotographic imaging members are disclosed including a multilayered imaging member having a substrate, a metal layer, a metal oxide layer, a siloxane blocking layer, an optional intermediate layer, a charge generating binder layer, and a charge transport layer. The intermediate layer between the blocking layer and a generator layer may contain a polyester and have a dry thickness of between about 0.1 micron (1,000 angstroms) and about 5 microns (50,000 angstroms). A polyester du Pont 49000 intermediate layer having a thickness of about 0.05 micrometer (500 angstroms) is described in some of the working examples. The transport layer may contain from about 25 to about 75 percent by weight of a diamine transport material.

U.S. Pat. No. 4,492,746 to Miyakawa et al, issued Jan. 8, 1985—Various electrophotographic imaging members are disclosed including an imaging member containing a polyester dispersed in PVK to increase adhesion to an electrically conductive substrate. The adhesion of various polyesters and PVK are set forth on tables 1–4 (see columns 9 and 10).

U.S. Pat. No. 4,477,551 to Fushida et al, issued Oct. 16, 1984—A photosensitive plate for electrophotography is disclosed comprising a photosensitive layer containing a polyvinyl carbazole type photoconductor. The photosensitive layer also contains a fused aromatic hydrocarbon dispersed in the polyvinyl carbazole. The reference discloses the use of THF as a solvent for dispersing the aromatic hydrocarbon in the polyvinyl carbazole. The use of the dispersed aromatic hydrocarbon enhances the mechanical properties of the photosensitive layer, specifically, the adhesion properties to substrates such as aluminum. Also disclosed in some of the working Examples is the addition of Polyester Adhesive 49000 from Du Pont Co.

U.S. Pat. No. 4,489,147 to Chang, issued Dec. 18, 1984—A photoconductive element is disclosed includes an electroconductive support, a charge generating layer and a charge transport layer. A polycarbonate resin having a weight average molecular weight ranging from 25,000 to 45,000 is used as an adhesive in a bonding layer on the electroconductive support and as a binder in the charge transport layer.

U.S. Pat. No. 4,489,148 to Horgan, issued Dec. 18, 1984—Various electrophotographic imaging members are disclosed including a multilayered imaging member having, between a substrate and a hole transporting layer, an adhesive layer which includes film-forming polymers such as polyesters and the like. An adhesive layer containing du Pont. 49,000 polyester resin is specifically disclosed in the working examples. The adhesive layer may be applied by means of a Bird applicator. Typically, the adhesive layer is of a thickness of less than about 0.3 microns (3,000 angstroms). Adhesive layers having a thickness of about 0.05 micrometer, (500 angstroms) are mentioned in column 10, lines 1–17 and 45–48 and Examples III–XVI. Hole transport material containing, for example, 10 to 75 weight percent of a diamine transport material is also disclosed.

U.S. Pat. No. 4,551,403 to Miyakawa et al, issued Nov. 5, 1985—A photosensitive material is disclosed for electrophotography comprising an electroconductive substrate, a charge generating layer and a charge transfer layer. The charge generating layer consists of a charge generating pigment dispersed in a thermoplastic polyester which is soluble in a chlorine type solvent. The charge transfer layer contains as the matrix resin a thermoplastic polyester which is soluble in tetrahydrofuran (THF). The thermoplastic polyesters provide improvements in adhesion to the substrate, surface hardness and abrasion resistance.

U.S. Pat. No. 4,565,760 to Schank, issued Jan. 21, 1986—Various overcoated electrophotographic imaging members are disclosed including a multilayered imaging member having, between a substrate and a hole transporting layer, a hole injecting electrode layer which includes polyesters such as PE-100 and a charge injecting material. This hole injecting electrode layer has a thickness of about 1 micron to about 20 microns (10,000 angstroms to 200,000 angstroms). Hole transport material containing, for example, 10 to 75 weight percent of a diamine transport material and generating layers containing, for example trigonal selenium in polyvinyl carbazole are also disclosed. A primer for overcoatings is also disclosed which may contain, for example, a polyester such as PE200 and polymethyl methacrylate.

U.S. Pat. No. 4,582,772 to Teuscher et al, issued Apr. 15, 1986—An electrophotographic imaging member is disclosed comprising a substrate, a transmissive semiconductive layer selected from the group consisting of indium-tin oxide, cadmium tin oxide, tin oxide, titanium oxides, titanium nitrides, titanium silicides, and mixtures thereof, a photogenerating layer and a charge transport layer, comprising, for example, an electrically active diamine material. An adhesive layer may be employed having a thickness of 0.1 microns (1,000 angstroms). The adhesive layer may contain 49000 polyester from E. I. duPont. Hole transport material containing, for example, 10 to 75 weight percent of a diamine transport material is also disclosed.

U.S. Pat. No. 4,378,418 to Chu, issued Mar. 29, 1983—Various electrophotographic imaging members are disclosed including a multilayered imaging member having a substrate, a hole injecting layer, a combined or separate hole transport and generating layer, and an optional insulating resin overcoating layer which includes film-forming polymers such as polyesters, polyethylene terephthalate, PE-100 and the like. Hole transport material containing, for example, 10 to 75 weight percent of a diamine transport material is also disclosed.

Thus, there is a continuing need for multilayered belt photoreceptors having improved resistance to delamination, cracking and componentleaching.

SUMMARY OF THE INVENTION

It is, therefore, an object of the present invention to provide an improved photoresponsive member which overcomes the above-noted disadvantages.

It is yet another object of the present invention to provide an improved electrophotographic member which exhibits greater resistance to delamination during slitting, ultrasonic seam welding and cycling.

It is still another object off the present invention to provide an improved electrophotographic member which exhibits greater dark decay stability when cycled at low and at high relative humidities.

It is another object of the present invention to provide an improved electrophotographic member which exhibits greater residual charge build up stability when cycled at low and at high relative humidities.

It is yet another object of the present invention to provide an electrophotographic imaging member which maintains seam integrity during cycling.

The foregoing objects and others are accomplished in accordance with this invention by providing a process for fabricating an electrophotographic imaging member comprising providing an electrically conductive layer, forming a charge blocking layer comprising an aminosilane reaction product on the electrically conductive layer, extruding a ribbon of a solution comprising an adhesive polymer dissolved in at least a first solvent on the electrically conductive layer to form a wet adhesive layer on the charge blocking layer, drying the wet adhesive layer to remove substantially all of the first solvent to form a dry continuous coating comprising the adhesive polymer having a thickness between about 0.08 micrometer (800 angstroms) and about 0.3 micrometer (3,000 angstroms), applying to the dry continuous coating comprising said adhesive polymer a mixture comprising charge generating particles dispersed in a solution of a binder polymer dissolved in at least a second solvent to form a wet charge generating layer, the binder polymer being miscible with the adhesive polymer, drying the wet charge generating layer to remove substantially all of the second solvent, and applying a charge transport layer, the charge transport layer being substantially nonabsorbing in the spectral region at which the charge generation layer generates and injects photogenerated holes but being capable of supporting the injection of photogenerated holes from the charge generation layer and transporting the holes through the charge transport layer, the adhesive polymer consisting essentially of a linear saturated copolyester reaction product of ethylene glycol and four diacids, the copolyester resin having the following formula:

$$\mathrm{HO}\overset{\overset{\mathrm{O}}{\|}}{\mathrm{C}}\text{-[diacid-diol]}_n\text{-OH}$$

wherein the diol is ethylene glycol, the diacids are terephthalic acid, isophthalic acid, adipic acid and azelaic acid, the mole ratio of the terephthalic acid to the isophthalic acid to the adipic acid to the azelaic acid is between about 3.5 and about 4.5 for terephthalic acid:

between about 3.5 and about 4.5 for isophthalic acid: between about 0.5 and about 1.5 for adipic acid: between about 0.5 and about 1.5 for azelaic acid, the total moles of diacid being in a mole ratio of diacid to ethylene glycol in the copolyester of 1:1, n is a number between about 250 and about 400 and the $T_g$ of the copolyester resin being between about 32° C. about 50° C.

The aminosilane is preferably a reaction product of the amino group of the silane with the —COOH and —OH end groups of the copolyester resin. Preferably, the hole transport layer comprises from about 30 percent to about 70 percent by weight of an active transport diamine compound.

A photoconductive imaging member of this invention may be prepared by providing a substrate having an electrically conductive surface, applying a hole blocking layer on the electrically conductive layer, applying the adhesive layer of this invention, applying a charge generation binder layer on the adhesive layer and applying a diamine charge transfer layer on the charge generation layer.

The substrate may be opaque or substantially transparent and may comprise numerous suitable materials having the required mechanical properties.

Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours P Co. or Melinex available from ICI.

The thickness of the substrate layer depends on numerous factors, including economical considerations, and thus this layer for a flexible belt may be of substantial thickness, for example, over 200 micrometers, or of minimum thickness less than 50 micrometers, provided there are no adverse effects on the final photoconductive device. In one flexible belt embodiment, the thickness of this layer ranges from about 65 micrometers to about 150 micrometers, and preferably from about 75 micrometers to about 125 micrometers for optimum flexibility and minimum induced surface bending stress when cycled around small diameter rollers, e.g. 19 millimeter diameter rollers. The surface of the substrate layer is preferably cleaned prior to coating to promote greater adhesion of the deposited coating. Cleaning may be effected by exposing the surface of the substrate layer to plasma discharge, ion bombardment and the like.

The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 angstrom units to about 750 angstrom units, and more preferably from about 50 Angstrom units to about 200 angstrom units for an optimum combination of electrical conductivity, flexibility and light transmission. The conductive layer may be an electrically conductive metal layer may be formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like. Magnetron sputtering of metals onto a substrate can be effected by a conventional type sputtering module under vacuum conditions in an inert atmosphere such as argon, neon, or nitrogen using a high purity metal target. The vacuum conditions are not particularly critical. In general, a continuous metal film can be attained on a suitable substrate, e.g. a polyester web substrate such as Mylar available from E. I. du Pont de Nemours & Co. with magnetron sputtering. It should be understood that vacuum deposition conditions may all be varied in order to obtain the desired metal thickness. Typical RF sputtering systems such as a modified Materials Research Corporation Model 8620 Sputtering Module on a Welch 3102 Turbomolecular Pump is described in U.S. Pat. No. 3,926,762, the entire disclosure of which is incorporated herein in its entirety. This patent also describes sputtering a thin layer of trigonal selenium onto a substrate which may consist of titanium. Another technique for depositing a metal by sputtering involves the use of planar magnetron cathodes in a vacuum chamber. A metal target plate may be placed on a planar magnetron cathode and the substrate to be coated can be transported over the metal target plate. The cathode and target plate are preferably horizontally positioned perpendicular to the path of substrate travel to ensure that the deposition of target material across the width of the substrate is of uniform thickness. If desired, a plurality of targets and planar magnetron cathodes may be employed to increase throughput, coverage or vary layer composition. Generally, the vacuum chamber is sealed and the ambient atmosphere is evacuated to about $5\times10^{-6}$ mm Hg. This step is immediately followed by flushing the entire chamber with argon at a partial pressure of about $1\times10^{-3}$ mm Hg to remove most residual wall gas impurities. An atmosphere of argon at about $1\times10^{-4}$ mm Hg is introduced into the vacuum chamber in the region of sputtering. Electrical power is then applied to the planar magnetron and translation of the substrate at approximately 3 to about 8 meters per minute is commenced.

If desired, an alloy of suitable metals may be deposited. Typical metal alloys may contain two or more metals such as zironium, niobium, tantalum, vanadium and hafnium, titanium, nickel, stainless steel, chromium, tungsten, molybdenum, and the like, and mixtures thereof. These alloys may be used as a target to deposit a layer comprising a mixture of the evaporated metals. The target may be made of a pressed mixture of the metal powders where alloy combinations may be difficult to achieve. The selected combinations of metal powders are measured, weighed, and thoroughly mixed and compressed to form a sputtering target. The conductive layer may comprise a plurality of metal layers. The multiple layers may, for example, all be vacuum deposited or a thin layer can be vacuum deposited over a thick layer prepared by a different techniques such as by casting. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer.

Planar magnetrons are commercially available and are manufactured by companies such as the Industrial Vacuum Engineering Company, San Mateo, Calif., Leybold-Heraeus, Germany and U.S., and General Engineering, England. Magnetrons generally are operated at about 500 volts and 120 amps and cooled with water circulated at a rate sufficient to limit the water exit temperature to about 43° C. or less. The use of magnetron sputtering for depositing a metal layer on a substrate is described, for example, in U.S. Pat. No. 4,332,276 to Mecket et al, the disclosure of this patent being incorporated herein in its entirety.

After deposition of the metal layer, a hole blocking layer must be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)-titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. No. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. This combination enhances electrical stability at low RH. The hydrolyzed silane has the general formula:

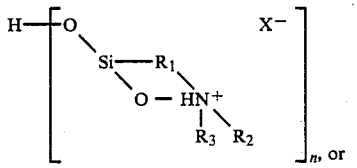

I

-continued

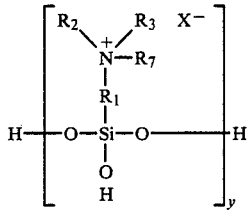

II or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, x is an anion of an acid or acidic salt, n is 1, 2, 3 or 4, and y is 1, 2, 3 or 4. The imaging member is preferably prepared by depositing on the metal oxide layer of a metal conductive anode layer, a coating of an aqueous solution of the hydrolyzed aminosilane at a pH between about 4 and about 10, drying the reaction product layer to form a siloxane film and applying an adhesive layer of this invention, and thereafter applying electrically operative layers, such as a photogenerator layer and a hole transport layer, to the siloxane film.

the hydrolyzed silane may be prepared by hydrolyzing a silane having the following structural formula:

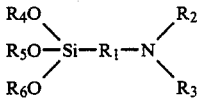

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which $R_1$ contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. when the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy group are replaced with hydroxyl groups. As hydrolysis continues, the hydrolyzed silane takes on the following intermediate general structure:

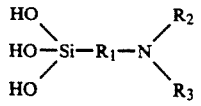

After drying, the siloxane reaction produce film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 1.5 percent by weight of the silane based on the total weight of the solution. A solution containing from about 0.05 percent by weight to about 0.2 percent by weight silane based on the total weight of solution are preferred for stable solutions which form uniform reaction product layers. It is improrrtant that the pH of the solution of hydrolyzed silane be carefully controlled to obtain optimum electrical stability. A solution pH between about 4 to about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling down has been observed with hydrolyzed amino silane solutions having a pH less than about 4.

Control of the pH of the hydrolyzed silane silution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation and cross-linking has occurred to form a siloxane reaction product film having stable electric chemical properties in a machine environment by merely washing the siloxane reaction produce film with water, toluene, tetrahydrofuran, methylene chloride or cyclohexanone and examining the washed siloxane reaction product film to compare infrared absorption of Si-O-wavelength bands between about 1,000 to about 1,200 $cm^{-1}$. If the Si-O-wavelegth bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydorxide molecules in the pores of the metal oxide layer. This siloxane coating is described in U.S. Pat. No. 4,464,450 to L. A. Teuscher, the disclosure of this application being incorporated herein in its entirety.

The blocking layer should be continuous and have a thickness of less than about 0.5 micrometer because greater thicknesses may lead to undesirably high residual voltage. A blocking layer of between about 0.005 micrometer (50 Angstroms) and about 0.3 micrometer (3000 angstroms) is preferred because charge neutralization after the exposure step is facilitated and optimum electrical performance is achieved. A thickness of between about 0.03 micrometer and about 0.06 micrometer is preferred for metal oxide layers for optimum electrical behavior. Optimum results are achieved with a siloxane blocking layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Generally, a weight ratio of blocking layer material and solvent of between about 0.05:100 and about 0.5:100 is satisfactory for spray coating.

An adhesive layer is applied by the process of this invention to the hole blocking layer. The adhesive layer applied by the process of this invention comprises a linear saturated copolyester reaction product of ethylene glycol with four diacids. The molecular structure of this linear saturated copolyester is represented by the following:

$$\overset{O}{\overset{\|}{HOC}}\text{-[diacid-diol]}_n\text{-OH}$$

where the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is preferably between about 3.5 and about 4.5 for terephthalic acid: between about 3.5 and about 4.5 for isophthalic acid: between about 0.5 and about 1.5 for adipic acid: between about 0.5 and about 1.5 for azelaic acid provided that total moles of diacid results in a mole ratio of diacid to ethylene glycol in the copolyester of 1:1. Optimum results are achieved with a diacid mole ratio of about 4:4:1:1. The molar structures of these four diacids and ethylene glycol are:

terephthalic acid

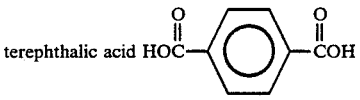

-continued isophthalic acid

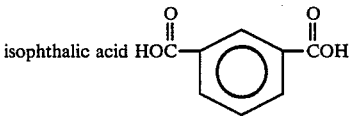

adipic acid $\overset{O}{\overset{\|}{HOC}}-(CH_2)_4-\overset{O}{\overset{\|}{COH}}$ azelaic acid $\overset{O}{\overset{\|}{HOC}}-(CH_2)_7-\overset{O}{\overset{\|}{COH}}$ ethylene glycol $HO-CH_2CH_2-OH$ The linear saturated copolyester used in the adhesive layer of this invention consists of alternating monomer units of ethylene glycol and the above four randomly sequenced diacids in the above indicated ratio and has a weight average molecular weight of about 70,000 and a $T_g$ of about 32° C. The linear saturated copolyester reaction product of ethylene glycol with four diacids used in the adhesive layer of this invention is commercially available as 49000 from E. I. du Pont de Nemours & Co. It is believed that the presence of the diacids containing alkylene groups in du Pont 49,000 linear saturated copolyester adhesive layers promote adhesive dissolution of the copolyester into the charge generation layer coating solvent (e.g. 50:50 weight percent tetrahydrofuran:toluene) upon application of the charge generation coating to form a blend of the copolyester and the charge generation binder. For dry thin linear saturated copolyester coatings [e.g. about 0.05 micrometers (500 angstroms)] prior to application of subsequent layers, total dissolution fo the copolyester results in poor adhesive strength thereby contributing to the delamination of multilayered photoreceptors during slitting, ultrasonic seam welding and transport over small diameter rollers. Adhesion to the blocking layer appears be enhaced by various factors including a chemical bond formed by a reaction product of an amino group of said silane with —COOH or —OH end groups of the linear copolyester resin. The linear saturated copolyester adhesive layers of this invention should comprise at least about 90 percent by weight based on the total weight of the adhesive layer.

Surprisingly, adhesive layers comprising the linear saturated copolyester reaction product of ethylene glycol with terephthalic acid, isophthalic acid, adipic acid and azelaic acid described above provides markedly superior electrical and adhesive properties only when it is applied to the blocking layer by extrusion coating techniques as compared to the same polymer material applied by conventional coating techniques such as gravure coating and Bird applicator coating. Also unexpected, is the absence of markedly superior electrical and adhesive properties when other similar types of copolyester resins are used in the adhesive layer such as copolyester resins having the following structural formula:

$$\overset{O}{\overset{\|}{HOC}}\text{-[diacid-diol]}_n\text{-OH}$$

wherein the diacid is selected from the group consisting of terephthalic acid, isophthalic acid, and mixtures thereof, the diol is selected from the group consisting of ethylene glycol, 2,2-dimethyl propane and mixtures thereof, the ratio of diacid to diol is 1:1, n is a number between about 175 and about 350 and the $T_g$ of the copolyester resin in between about 50° C. about 80° C. Typical polyester resins having the above structure immediately above include, for example, Vitel PE-100, Vitel PE-200, Vitel PE-200D, and Vitel PE-222, all available from Goodyear Tire and Rubber Co.

Another example of a polyester resin employed in the adhesive layers of the prior art and which does not provide the superior electrical and adhesive properties of the linear saturated copolyester reaction product of ethylene glycol with terephthalic acid, isophthalic acid, adipic acid and azelaic acid of this invention is a copolyester available from Goodyear Tire & Rubber Co. as Vitel PE-100. This polyester resin is a linear saturated copolyester of two diacids and ethylene glycol. The molecular structure of this linear saturated copolyester is represented by the following structure:

$$\overset{O}{\overset{\|}{HOC}}\text{-[diacid-ethylene glycol]}_n\text{-OH}$$

where the ratio of diacid to ethylene glycol in the copolyester is 1?1. The diacids are terephthalic acid and isophtalic acid. The ratio of terephthalic acid to isophthalic acid is 3:2. The molecular structures of these acids and ehthylene glycol are presented above. The Vitel PE-100 linear saturated copolyester consists of alternating monomer units of ethylene glycol and two randomly sequenced diacids in the above indicated ratio and has a molecular weight of about 50,000 and a $T_g$ of about 71° C.

Another polyester resin for adhesive layers of the prior art which does not provide the superior electrical and adhesive properties of the linear satrurated copolyester reaction product of ethylene glycol with terephthalic acid, isophthalic acid, adipic acid and azelaic acid of this invention is available from Goodyear Tire & Rubber Co. as Vitel PE-200. This polyester resin is a linear saturated copolyester of two diacids and two diols. The molecular structure of this linear saturated copolyester is represented by the following structure:

$$\overset{O}{\overset{\|}{HOC}}\text{-[Diacid-Diol]}_n\text{-OH}$$

where the ratio of diacid to ethylene glycol in the copolyester is 1:1. The diacids are terephthalic acid and isophthalic acid. The ratio of terephthalic acid to isophthalic acid is 1.2:1. The molecular structures of these acids and ethylene glycol are presented above. The two diols are etylene glycol and 2,2-dimethyl Propane Diol. The ratio of etylene glycol to dimethyl propane diol is 1.33. The molecular structure of ethylene glycol is presented above and the molecular structure of dimethyl propane diol is as follows:

$$\text{2,2-Dimethyl Propane Diol } HOCH_2-\overset{\overset{CH_3}{|}}{\underset{\underset{CH_3}{|}}{C}}-CH_2OH$$

The Goodyear PE-200 linear saturated copolyester consists of randomly alternating monomer units of the two diacids and the two diols in the above indicated ratio and has a molecular weight of about 45,000 and a $T_g$ of about 67° C.

As shown above, the diacids from which some of the polyester resins of the prior art can also be derived from terephthalic and isophthalic acids. The diols from which the polyester resins of the prior art can be derived can also include ethylene glycol. Other glycols such as 2,2-dimethyl propane diol may also be employed in combination with ethylene glycol to prepare polyesters resins of the prior art.

To achieve the improved results of this invention, it is critical that the adhesive copolyester coating mixture be applied by extrusion as a ribbon of the coating material onto the blocking layer. Surprisingly, little change in residual voltage and electrical cycle-down are observed under low and high humidity during extensive cycling of the photoreceptors prepared by the process of this invention. Extrusion coating techniques and apparatus for materials such as coating compositions containing carbon black and a polyester and coating compositions containing an alkylidene arylene compound and a polycarbonate resin are described in U.S. Pat. No. 4,521,457 to Russell et al. Although the disclosure of U.S. Pat. No. 4,521,457 is directed to the simultaneous side by side extrusion of ribbons of two different materials by using a spacing member within the extrusion nozzle to separate the ribbons of the two different materials, the same apparatus without the spacing member may be used to extrude a single ribbon of the linear saturated copolyester adhesive layer coating of this invention. As described in U.S. Pat. No. 4,521,457, the extrusion nozzle comprises a coating material reservoir which supplies the coating material through a narrow extrusion slot having parallel walls and out an outlet. The extruded adhesive layer coating composition is in the shape of a ribbon as it flows through the extrusion slot. Extrusion coating of charge generating layers and charge transport layers are described in U.S. Pat. No. 4,786,570. The entire disclosures of U.S. Pat. No. 4,521,457 and U.S. Pat. No. 4,786,570 are incorporated herein by reference.

The linear saturated copolyester adhesive coating applied by the process of this invention is extruded as a solution. Any suitable solvent or solvent mixtures may be employed to form a coating solution of the copolyester. Typical solvents inlcude tetrahydrofuran, cyclohexanone, methylene chloride, 1,1-trichloroethane, 1,1,2-trichlorotethane, trichloroethylene, toluene, and the like, and mixtures thereof. Generally, mixtures of solvents are preferred to achieve optimum control of the evaporation rate during drying of the adhesive layer. Generally, the organic solvent which dissolves the adhesive polymer has a sufficiently low boiling point to permit evaporation under the drying conditions utilized to form a uniform, continuous adhesive layer film. Typical boiling point ranges for oragnic solvents range from between about 20° C. and about 115° C. at ambient pressuure and humidities.

Satisfactory results may be achieved with linear saturated copolyester solids to solvent ratios of between about 0.1 and about 2.5 percent by weight solids based on total weight of the solution. A ratio of between about 0.35 and about 2.0 percent is preferred and optimum results are achieved with a ratio between about 0.75 and about 1.5 percent by weight solids based on the total weight of the solution. These concentrations generally provide the desired coating viscosities and coating thickness. Satisfactory wet coating thickness range between about 8 μm (80,000 angstroms) and about 40 μm (400,000 angstroms). Wet thicknesses below about 8 μm tend to cause non-uniformity in the film thickness, whereas wet thicknesses greater than about 40 μm result in running of the coating. A wet thickness range betweena bout 10 μm (100,000 angstroms) and about 30 μm (300,00 angstroms is preferred with optimum results being achieved with a wet thickness between about 13 μm (130,000 angstroms) and about 22 μm (220,000 angstroms). Generally, the solids concentration, wet thickness, solvent and drying conditions are selected to prevent running of the coating after it is applied. The deposited wet coating should be uniform and continuous. In contrast to the process of this copolyester extrusion coating invention, to achieve a continuous adhesive layer thickness of about 900 angstroms to 3,000 angstroms by prior art gravure coating techniques, it is necessary that the solids concentration ratio be between about 5 percent and about 20 percent by weight based on the total weight of the coating mixture of polyester and solvent.

Generally the relative speeds between the extrusion coating die and the surface of the support member bearing the blocking layer to be coated can be as high as about 250 feet per minute. However, it is believed that greater relative speeds may be utilized if desired. Satisfactory coating results may be achieved with a stationary nozzle and substrate speeds between about 10 feet per minute and 250 feet per minute. A substrate speed between about 70 feet per minute and 200 feet per minute is preferred and optimum coating achieved with substrate speeds of between about 100 feet per minute and about 150 feet per minute. The speed of the extruded coating ribbon and the substrate to be coated may be synchronized or be at different speeds. The relative speed should be controlled in accordance with the flow velocities of the ribbon-like coating stream emitted from the extrusion nozzle. Thus, curtain coating (where the ribbon-like coating stream path is perpendicular to the surface of the surface to be coated) and bead coating (where a slight bead of coating material is formed perpencidular to the direction of the stream path) will normally call for less relative speed than jet coating (where the stream is ejected from the extrusion nozzle at high velocities).

The flow velocities or flow rate per unit width of the narrow extrusion slot for the ribbon-like stream should be sufficient to fill the die to prevent dribbling and to bridge the gap from the nozzle outlet to the surface of the support member bearing the blocking layer. However, the flow velocity should not exceed the point where non-uniform coating thicknesses are obtained due to splashing or puddling of the coating composition. Generally, the ribbon of coating material in the extrusion nozzle as it approaches the nozzle opening is maintained under laminar flow conditions. Varying the die to support member surface distance and the relative die to support member surface speed will help compensate for high or low coating composition flow velocities. Generally, satisfactory results are achieved when extrusion nozzles having a slot gap height of between about 50 micrometers and about 200 micrometers. An extrusion nozzle slot gap height between about 100 micrometers and about 150 micrometers are preferred and optimum achieved with a height between about 120 micrometers and about 140 micrometers.

The distance between the substrate to be coated and the opening of the extrusion nozzle may be varied and depends, to some extent, on the angle of the plane of the ribbon being extruded from the nozzle and the relative speed of the coating ribbon and the substrate to be coated. Generally, satisfactory results may be achieved with a distance between the coating nozzle opening and the substrate to be coated between about 100 micrometers and about 150 micrometers. Satisfactory results may be achieved with a trailing nozzle angle of about 60° to a vertical nozzle angle of about 90°.

The extrusion coating step of this invention can accommodate a wide range of coating composition viscosities of from about 0.19 centipoise to about 0.38 centipoise. Generally, lower coating composition viscosities tend to form thinner wet coatings whereas coating compositions having high viscosities tend to form thicker wet coatings. Obviously, wet coating thickness will form thinner dry coatings when the solvent in the deposited coating composition is removed during drying.

The pressures utilized to extrude the adhesive coating composition of this invention through the narrow extrusion slots depends upon the size of the slot, viscosity of the coating compositions, distance between the coating nozzle opening and the substrate to be coated, relative speeds of the nozzle and substrate, and whether curtain, bead or jet deposition is contemplated. Any suitable temperature may be employed in the coating deposition process. Generally, ambient temperatures are preferred for deposition of the adhesive coating solutions.

The adhesive layer of this invention should be maintained as a continuous layer throughout all of the other coating process steps that follow the deposition of the adhesive layer. Thus, where components of subsequently layers dissolve the linear saturated copolyester reaction product of ethylene glycol with terephthalic acid, isophthalic acid, adipic acid and azelaic acid, the originally deposited dry adhesive layer should be sufficiently thick so that a continuous distinguishable layer remains even after some of the original polyester resin material forms a blend zone with film forming binder from a subsequently applied charge generating layer. To achieve robust adhesion, a thick dry layer of the linear saturated copolyester resin must be formed. Satisfactory results may be achieved with an originally deposited dry thickness between about 0.08 micrometer (800 angstroms) and about 0.3 micrometer (3,000 angstroms). Preferably, the adhesive layer is continuous and uniform and has a dry thickness between about 0.09 micrometer (900 angstroms) and about 0.25 micrometer (2,500 angstroms) and more preferably between about 0.1 micrometer (1,000 angstroms) and about 0.17 micrometer (1,700 angstroms) prior to application of the charge generator layer. At thickness of less than about 0.08 micrometer (800 angstroms), the adhesion between the generating layer and the blocking layer is poor and delamination occurs when the belt is transported over small diameter supports such as rollers and curved skid plates. When the thickness of the originally deposited adhesive layer of this invention is greater than about 0.09 micrometer (900 angstroms), high adhesion strength is achieved which can endure extended cycling. The adhesive layer should be dried.

Conventional techniques for applying an adhesive layer coating mixture to the charge blocking layer such as spraying, dip coating, roll coating, wire wound rod coating, gravure coating, Bird applicator coating, and the like do not provide the improved results achieved by the process of this invention where the linear saturated copolyester reaction product of ehtylene glycol with terephthalic acid, isophthalic acid, adipic acid and azelaic acid is applied to the blocking layer by extrusion. Drying of the deposited coating may be effected by any suitable conventional technique such as oven drying, infra red radiation drying, air drying and the like.

The dried adhesive layers of this invention should contain at least about 90 percent by weight, based on the total weight of the adhesive layer, of the copolyester resin of this invention to achieve adequate adhesive strength for applications involving transport of the photoreceptor belt over small diameter rollers, e.g. 19 mm, and blade cleaning. Up to about 10 percent of other film forming materials that are miscible with the copolyester resin and which do not adversely affect electrical and mechanical properties may be added.

Bonding of the adhesive layer polyester of this process invention to the aminosiloxane blocking layer is believed to be derived by formation of an acid-base interfacial bond and further supplemented by strong nucleophilic interaction to form an extremely strong bond.

Any suitable photogenerating layer may be applied to the adhesive layer which can then be overcoated with a contiguous hole transport layer as described. Examples of photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo ant anthrone pigments, benzimidazole perylene, substituted 2,4-diamino-triazines desclosed in U.S. Pat. No. 3,422,781, polynuclear aromatic quinones available from Allied Chemical Corporation under the trade name Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phonxy resins, epoxy resins, phenolic resins, polystyrene and acrylonitrile copolymers polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generator layer binder polymer should dissolve the upper surface previously extrusion deposited and dried copolyester adhesive in the adhesive layer, dissolve the binder polymer utilized in the charge generating layer and disperse the photogenerating pigment particles present in the charge generating layer. The use of a solvent in the charge generating layer which dissolves both the binder polymer for the charge generating layer and the adhesive polymer causes the formation of a polymer blend zone in which the adhesive polymer at the outer surface of the adhesive layer and the binder polymer for the charge generating layer adjacent the interface with the adhesive layer intermix or blend. The adhesive polymer must be miscible with the binder polymer of the charge generator layer sufficient to form up to a 1:1 parts by weight blend. If no polymer blending occurs at the interface between the adhesive layer and charge generating layer, deliberate fracturing of the charge generating layer from the substrate followed by microscopic examination of the substrate will result in the observation that no carry over of photogenerating particles onto the substrate occurs. The fracturing test may be conducted by partially cutting through the various coatings down to the substrate, inserting a razor blade between the substrate and the layers of coating to form a shallow slit and thereafter reverse peeling the coating layers from the substrate. The absence of blending causes a reduction in adhesion between the adhesive layer and the charge generating layer and can cause delamination during the flexing of photoreceptor belts. Also, it is believed that the presence of chains of miscible polymers from the photogenerating binder layer contributes to polymer chain interpenetration with chains from the copolyester resins from the adhesive layer of this process invention thereby providing a polymer blend zone of entangled polymers and enhancing resistance to delamination during transport over small diameter rollers. If the adhesive layer disappears during the formatin of the generating layer because all of the adhesive layer polymer is blended with the binder polymer for the charge generation layer, adhesion between the charge generating layer and the blocking layer diminishes dramatically and spontaneous delamination has been observed when the photoreceptor is in the form of a web. Thus, a distinguishable layer of the copolyester resin should remain between the blocking layer and the polymer blend zone after all coatings have been applied to the adhesive layer.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected providing the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as over drying, infra red radiation drying, air drying and the like to remove substantially all of the solvents utilized in applying the coating.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be transmitting in the wavelength region of use. The charge transport layer in conjunction with the generation layer is a material which is an insulator to the extent that an electrostatic charge placed on the transport layer is not conducted in the absence of illumination.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

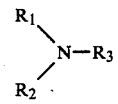

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to ~carbon atoms. The substituents should be free from electron withdrawing groups such as $NO_2$ groups, CN groups, and the like. Typical aromatic amine compounds that are represented by this structural formula include:

I. Triphenyl amines such as:

-continued

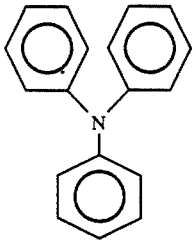

II. Bis and poly triarylamines such as:

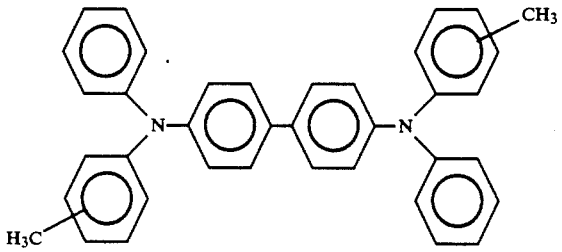

III. Bis arylamine ethers such as:

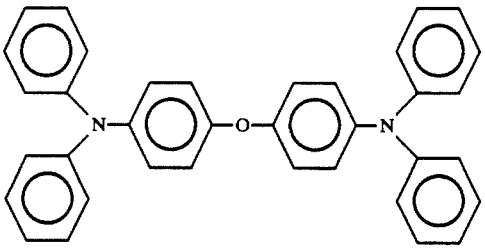

and

IV. Bis alkyl-arylamines such as:

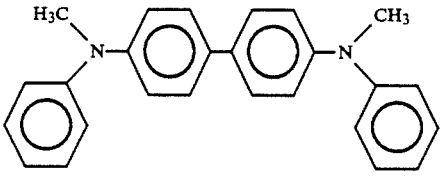

A preferred aromatic amine compound has the general formula:

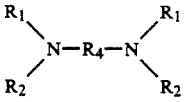

wherein $R_1$, and $R_2$ are defined above and $R_4$ is selected from the group consiting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane, N,N'-(bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-dimaine, and the like dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve the linear copolyester resin employed in the adhesive layer may also be utilized. Typical solvents include Tetrahydrofuran, toluene, Trichloroethylene, 1,1,2-trichloroethane, 1,1,1-trichloroethane, and the like.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company, polyether carbonates, 4,4'-cyclohexylidene diphenyl polycarbonate. Methylene chloride solvent is a desirable component of the charge transport layer coating mixture for adequate dissolving of all the components and for its low boiling point.

Example of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

An especially preferred multilayered photoconductor comprises a charge generation layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

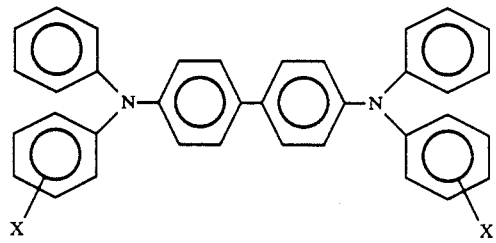

wherein X is selected from the group consisting of an alkyl group, having from 1 to about 4 carbon atoms and chlorine, the photoconductive layer exhibiting the capability of photogeneration of holes and injection of the holes and the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the doposited coating may be effected by any suitable conventional technique such as over drying, infra red radiation drying, air drying and the like.

Generally, the thickness of the hole transport layer is between about 5 to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Other layers such as conventional ground strips comprising, for example, conductive particles dispersed in a film forming binder may be applied to one edge of the photoreceptor in contact with the zirconium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

BRIEF DESCRIPTION OF THE DRAWINGS

A more ocmplete understanding of the process of the present invention can be obtained by reference to the accompanying drawings wherein.

DETAILED DESCRIPTION OF THE DRAWINGS

Figure 1:
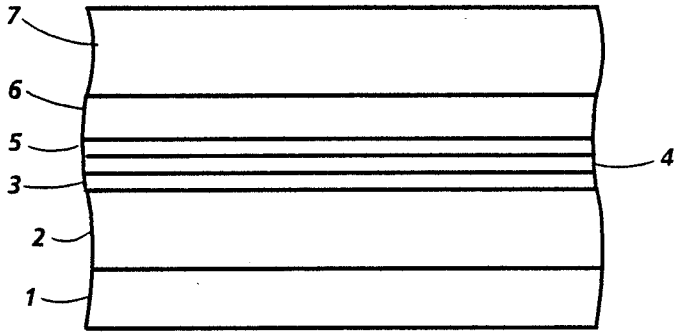
FIG. 1 is a schematic illustration of a multilayered photoreceptor.

Referring to FIG. 1, a photoreceptor is shown having an anticurl back coating 1, a supporting substrate 2, an electrically conductive ground plane 3, an aminosiloxane hole blocking layer 4, an adhesive layer 5, a charge generating layer 6, and a charge transport layer 7.

Figure 2:
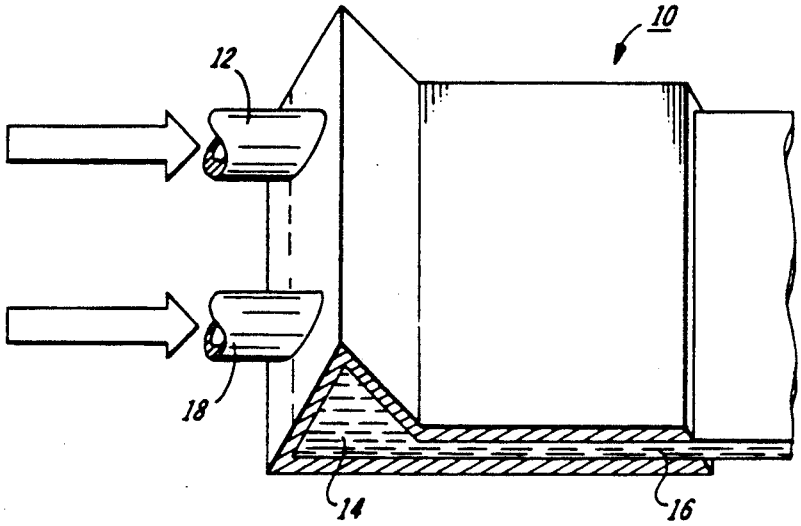
FIG. 2 is a schematic, isometric, sectional view of an extrusion die from which a ribbon-like stream of a coating composition is extruded.

Referring to FIG. 2, a die designated by the numeral 10 is disclosed. This type of die is similar to that described in U.S. Pat. No. 3,920,862. In this coating device, a coating composition is continuously moved by a conventional pump (not shown) or other suitable well known means such as a gas pressure system through inlets 12 and 18 into a common reservoir chamber 14 from which the coating composition is extruded through a narrow extrusion slot 16.

Figure 3:
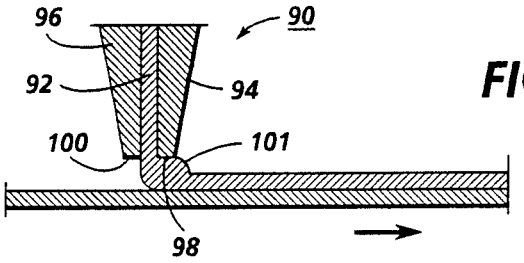
FIG. 3 is a schematic, sectional view of ribbon-like streams of coating material applied from a die to the surface of a support member where the coating material forms a bead on the downstream side of the die means.

In FIG. 3, the downstream end of a die 90 is illustrated in which narrow extrusion slot 92 si formed between lips 94 and 96. The lip ends 98 and 100 are spaced from the surface 102 of a support member 104 moving in the direction depicted by the arrow. The rate of flow of the coating compositions through narrow extrusion slot 92, the distance between die lip ends 98 and 100 from the surface 102 of support member 104 and the relative rate of movement between surface 102 and die 90 are adjusted to form a bead 101 of the coating material under downstream lip end 98. Although the thickness of the ribbon-like stream of coating materials is momentarily altered at this point during the coating process, good uniform coatings on the surface 102 are obtained.

Figure 4:
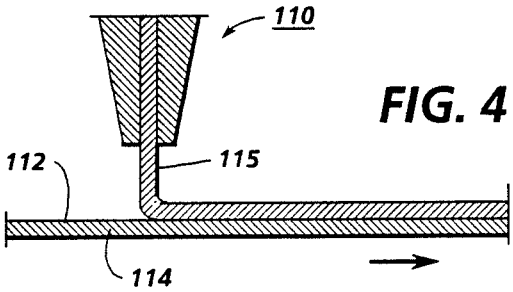
FIG. 4 is a schematic, sectional view of ribbon-like streams of coating material applied from a die means to the surface of a support member where the ribbon-like stream is a free-falling ribbon.

In FIG. 4, the distance between die 110 and the surface 112 of support member 114, flow rate of the coating material 115, and relative speed between the die 110 and surface 112 are adjusted to allow the coating material to fall by gravity onto surface 112 without splashing or puddling to form uniform coatings on surface 112. The relative speed between the nozzle 110 and the surface 112 can be increased to cause the curtain of coating material 115 to change from a vertical curtain to one that angles downstream.

Figure 5:
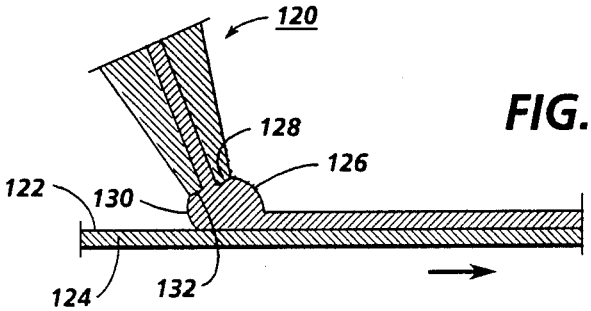
FIG. 5 is a schematic, sectional view of ribbon-like streams of coating material applied from a die means to the surface of a support member where beads of coating material are formed upstream and downstream of the die means positioned at a trailing angle.

In FIG. 5, the distance between die 120 and surface 122 of support member 124, flow rate of the composition and relative speed between the die 120 and surface 122 are controlled to form a bead 126 under the downstream die lip end 128 and bead 130 under upstream die lip end 132. Satisfactory uniform coatings are obtained with this arrangement also. The flow rate for this embodiment is greater than that shown in FIG. 3 if all other materials and conditions are the same.

Figure 6:
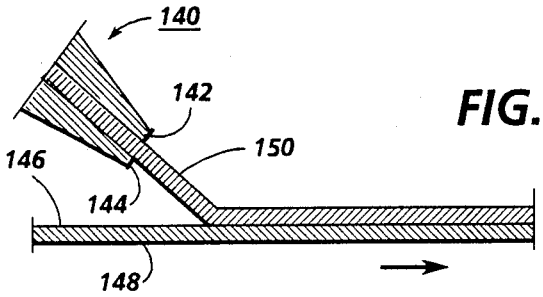
FIG. 6 is a schematic, sectional view of ribbon-like streams of coating material applied from a die means to the surface of a support member where the ribbon-like material forms a unitary unsupported stream prior to contacting the surface of the support member.

In FIG. 6, the flow rate of coating compositions through die 140, the distance between die lip ends 142 and 144 from the surface 146 of support member 148 and the relative speed between the die 140 and surface 146 are adjusted to provide an unsupported ribbon-like stream of coating materials 150 to project from die lip ends 142 and 144 to the surface 146 of support member 148. This technique also provides good uniform coatings on the surface 146 of support member 148.

The die lip ends may be of any suitable configuration including squared knife and the like. A flat squared end is preferred for the bead coating embodiments illustrated, for example, in the Figures, particularly for high viscosity fluids. The flat die lip ends appear to support and stabilize the beads during bead coating operations.

Although reservoirs are depicted in all of the figures above, one may, if desired, eliminate the reservoirs and feed the coating composition directly into the narrow extrusion slots. However, more uniform feeding occurs when reservoirs are utilized for high viscosity compositions. Also, multiple inlets with multiple reservoir chambers may be utilized to apply a plurality of ribbon-like streams on a wide support member which may thereafter be split in a longitudinal direction to provide plurality of coated elements.

Selection of the narrow extrusion slot height which determines the thickness of the ribbon of coating material generally depends upon factors such as the fluid viscosity, flow rate, distance to the surface of the support member, relative movement between the die and the substrate to be coated, and the thickness of the coating desired. Generally, satisfactory results may be achieved with slot heights between about 50 micrometers and about 200 micrometers. It is believed, however, that heights greater than 200 micrometers will also provide satisfactory results. Good coating results have been achieved with slot gap heights between about 100 micrometers and about 150 micrometers. Optimum control of coating uniformity is achieved with slot gap heights between about 120 micrometers and about 140 micrometers. The width of the ribbon-like stream varies in accordance with the width of the support surface to which the adhesive coating composition is applied.

The roof, sides and floor of the narrow extrusion slot should preferably be parallel and smooth to ensure achievement of laminar flow. The length of the narrow extrusion slot from the entrance opening to the outlet opening should long enough to ensure achievement of laminar flow and substantial equalization of pressure from one edge of the ribbon-like stream to the opposite edge.

The gap distance between the die lip ends and the surface of the supporting substrate depends upon variables such as viscosity of the coating material, the velocity of the coating material and the angle of the narrow extrusion slot relative to the surface of the support member. Generally speaking, a smaller gap is desirable for lower flow rates. The distance between the die lip ends and the surface of the support member is shortest when bead coating is illustrated in FIGS. 3 and 5 are utilized. A greater distance may be employed with higher flow rates and support substrate speeds as illustrated in FIG. 6. Maximum distance between the die lip ends and the surface of the substrate member may be achieved with curtain coating as shown in FIG. 4. Regardless of the technique employed, the flow rate and distance should be regulated to avoid splashing, dripping, puddling of the coating material.

The electrophotographic member prepared by the process of the present invention may be employed in any suitable and conventional electrophotographic imaging process which utilizes negative charging prior to imagewise exposure to activating electromagnetic radiation. After the imaging surface of an electophotographic member is uniformly charged with a negative charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, positively charged toner particles are attracted to the negatively charged electrostatic areas of the imaging surface and for reversal development, negatively charged toner particles are attracted to the discharged areas of the imaging surface.

The electrophotographic member prepared by the process of the present invention exhibits greater resistance to delamination during slitting, ultrasonic seam welding and cycling.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

Example I

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 5 percent (0.023 mole) solution of 3-aminopropyl triethoxylsilane to the oxidized surface of the aluminum layer with a gravure applicator. The deposited coating was dried at 135° C. in a forced air oven to form a layer having a thickness of 450 Angstroms. An adhesive layer coating solution was prepared containing 2.3 percent by weight linear saturated copolyester resin, (49000, available from the E. I. du Pont de Nemours & Co.) dissolved in a 70:30 by weight tetrahydrofuran:cyclohexanone solvent mixture. This linear saturated copolyester is the reaction product of ethylene glycol and diacids where the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1 with the total moles of diacid forming a mole ratio of diacid of ethylene glycol in the copolyester of 1:1. The adhesive layer solution was applied with a gravure applicator to the siloxane coated base to form a coating having a wet thickness of about 2.17 micrometers (21,700Å). The adhesive layer coating was dried at 135° C. in a forced air oven to form a coating having a thickness of abut 0.05 micrometer (500Å). A slurry coating solution of 3 percent by weight sodium doped trigonal selenium having a particle size of about 0.05 micrometer to 0.2 micrometer and about 6.8 percent by weight polyvinylcarbazole and 2.3 percent by weight N,N'-diphenyl-N,N'-bis(3 methylphenyl)-[1,1'-biphenyl]-4,4'diamine in a 1:1 by volume mixture of tetrahydrofuran and toluene was extrusion coated onto the polyester coating to form a layer having a wet thickness of 26 micrometers. The coated member was dried at 135° C. in a forced air oven to form a layer having a thickness of 2.5 micrometers. A charge transport layer is formed by applying a solution of Makrolon, a polycarbonate resin having a molecular weight from about 50,000 to about 100,000 available from Farbenfabriken Bayer A. G. and N,N'-diphenyl-N,N'-bis(3-methylphenyl)-[1,1'-biphenyl]-4,4'-diamine dissolved in methylene chloride to ultimately provide 50 percent by weight loadings of N,N'-diphenyl-N,N'-bis(3-methylphenyl)-[1,1'-biphenyl]-4,4'-diamine, respectively, in the dried transport layer. The transport layer was coated on top of the generator layer with a Bird applicator and dried at temperature of about 135° C. to form 24 micrometer thick dry layer of hole transporting material. An anti curl back coating was also applied to the back side of the polyester film.

EXAMPLE II

The materials, procedures and conditions described in Example I were repeated except that the concentration of the coating of copolyester resin, (49000, available from the E. I. du Pont de Nemours & Co.) applied with a gravure applicator was changed to 5 percent by weight copolyester to form a thicker coating. The deposited coating had a wet thickness o about 1.6 micrometers (16,000Å). The copolyester resin coating was dried at 135° C. in a forced air oven to form a coating having a thickness of about 0.08 micrometer (800 angstroms).

EXAMPLE III

The materials, procedures and conditions described in Example II were repeated except that the concentration of the coating of copolyester resin, (49000, available from the E. I. du Pont de Nemours & Co.) applied with a gravure applicator was changed to 11.5 percent by weight polyester to form a thicker coating. The deposited coating had a wet thickness of about 1.3 micrometers (13,000Å). The copolyester resin coating was dried at 135° C. in a forced air oven to form a coating having a thickness of about 0.15 micrometer (150,000 angstroms).

EXAMPLE IV

The materials, procedures and conditions described in Example II were repeated except that the concentration of the coating of copolyester resin, (49000, available from the E. I. du Pont de Nemours & Co.) applied with a gravure applicator was changed to 20 percent by weight polyester to form a thicker coating. The deposited coating had a wet thickness of about 1.5 micrometers (15,000Å). The copolyester resin coating was dried at 135° C. in a forced air oven to form a coating having a thickness of about 0.3 micrometer (3,000 angstroms).

EXAMPLE V

The materials, procedures and conditions described in Example I were repeated except that the adhesive layer was applied with a Bird applicator rather than the gravure applicator and the concentration of the coating of copolyester resin, (49000, available from the E. I. du Pont de Nemours & Co.) was changed to 0.5 percent by weight polyester. The deposited coating had a wet thickness of about 10 micrometers (100,000Å). The copolyester resin coating was dried at 135° C. in a forced air oven to form a coating having a thickness of about 0.05 micrometer (500 angstroms). The Bird applicator gap size was 12.7 micrometers (0.5 mil).

EXAMPLE VI

The materials, procedures and conditions described in Example V were repeated except that the concentration of the coating of copolyester resin, (49000, available from the E. I. du Pont de Nemours & Co.) was changed to 1 percent by weight polyester. The deposited coating had a wet thickness of about 10 micrometers (100,000 angstroms) and a dried thickness of about 0.1 micrometer (1,000 angstroms).

EXAMPLE VII

The materials, procedures and conditions described in Example V were repeated except that the concentration of the coating of copolyester resin, (49000, available from the E. I. du Pont de Nemours & Co.) was changed to 2 percent by weight polyester. The deposited coating had a wet thickness of about 10 micrometers (100,000 angstromsÅ) and a dried thickness of about 0.2 micrometer (2,000 angstroms).

EXAMPLE VIII

The materials, procedures and conditions described in Example V were repeated except that the concentration of the coating of Co.) was changed to 3 percent by weight polyester. The deposited coating had a wet thickness of about b 10 micrometers (100,000 angstroms) and a dried thickness of about 0.3 micrometers (3,000 angstroms).

EXAMPLE IX

The materials, procedures and conditions described in Example I were repeated except that the coating of copolyester resin, (49000, available from the E. I. du Pont de Nemours & Co.) was applied to the siloxane coated base by means of an extrusion die similar to the die illustrated in FIG. 4 and the concentration of the coating of copolyester resin was changed to 0.75 percent by weight copolyester. The polyester substrate film coated with the titanium/zirconium layer and siloxane hole blocking layer was transported beneath the die at about 30.5 meters per minute. The length, width, and gap height of the narrow extrusion slot in the die for the ribbon-like stream was 2.54 mm, 482.6 mm, and 0.12 mm, respectively. The deposited coating had a wet thickness of about 8 micrometers (80,000 angstroms). The copolyester resin coating was dried at 135° C. in a forced air oven to form a coating having a dry thickness of about 0.06 micrometer (600 angstroms).

EXAMPLE X

The materials, procedures and conditions described in Example IX were repeated except that the deposited coating had a wet thickness of about 13.3 micrometers (133,000Å) and a dried thickness of about 0.1 micrometer (1,000 angstroms). The wet thickness change was achieved by changing the pump pressure.

EXAMPLE XI

The materials, procedures and conditions described in Example IX were repeated except that the deposited coating had a wet thickness of about 21.3 micrometers (213,000 angstroms) and a dried thickness of about 0.16 micrometer (1,600 angstroms).

EXAMPLE XII

The materials, procedures and conditions described in Example IX were repeated except that the deposited coating had a wet thickness of about 32 micrometers (320,000Å) and a dried thickness of about 0.24 micrometer (2,400 angstroms).

EXAMPLE XIII

The electrical properties of other photoreceptor samples prepared according to Example I through XII were evaluated with a xerographic testing scanner comprising a cylindrical aluminum drum having a diameter of 9.55 inches. The photoreceptor test samples were taped onto the drum which carried the samples at a constant speed of 30 inches per second. A direct current pin corotron, exposure light, erase light, and five electrometer probes were mounted around the periphery of the mounted photoreceptor samples. The sample charging time was 33 milliseconds. Both exposed and erase light were broad band white light (400–700 mm) outputs, each supplied by a 300 watt output Xenon arc lamp. The relative locations of the probes and lights are indicated in the table below:

| ELEMENT | ANGLE | POSITION | DISTANCE FROM PHOTORECEPTOR |
|---|---|---|---|
| CHARGE | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The photoreceptor test samples were first rested in the dark for at least 60 minutes to ensure achievement of equilibrium at 5% RH at 21° C. and 40% RH at 21° C. Each sample was then negatively charge in the dark to a development potential of about −900 volts. The charge acceptance of each sample and its residual potential afer discharge by front erase exposure to 400 ergs/cm$^2$ of light exposure were recorded. The testing procedure was carried out at 21° C. and under two humidity conditions, i.e., 5 percent relative humidity and 40 percent relative humidity 21° Δ $V_R$ (After 50K Cycles) of Photoreceptor Devices Using Various 49000 Dry Thicknesses

| | Gravure Coating EXP. I | II | III | IV | |
|---|---|---|---|---|---|
| | 500Å (0.05 μm) | 800Å (0.08 μm) | 1,500Å (0.15 μm) | 3,000Å (0.3 μm) | ←Dried Film |
| | 21,700Å | 16,000Å | 13,000Å | 15,000Å | ←Wet Film |
| RH | 2.3% | 5% | 11.5% | 20% | ←Coating Solution |
| 5% | −10 Volts | −11 | −10 | −15 | |
| 40% | 30 | 38 | 51 | 58 | |
| | **Hand Coating W/Bird Applicator EXP. V** | **VI** | **VII** | **VIII** | |
| | 500Å (0.05 μm) | 1,000A (0.1 μm) | 2,000A (0.2 μm) | 3,000Å (0.3 μm) | ←Dried Film |
| | 100,000Å (10 μm) | 100,000Å (10 μm) | 100,000Å (10 μm) | 100,000Å (10 μm) | ←Wet Film |
| RH | 0.5% | 1% | 2% | 3% | ←Coating Solution |
| 5% | 18 Volts | 40 | 37 | 39 | |
| 40% | 21 | 30 | 55 | 55 | |
| | **Extrusion Coating EXP. IX** | **X** | **XI** | **XII** | |
| | 600Å (0.06 μm) | 1,000Å (0.1 μm) | 1,600Å (0.16 μm) | 2,400Å (0.24 μm) | ←Dried Film |
| | 80,000Å | 133,000Å | 213,000Å | 320,000Å | ←Wet Film |
| RH | 0.75% | 0.75% | 0.75% | 0.75% | ←Coating Solution |
| 5% | 21 Volts | 19 | 15 | 12 | |
| 40% | 23 | 16 | 15 | 10 | |

The results in the Tables above clearly demonstrate the markedly low change in residual voltage characteristics during cycling at both high and low humidities exhibited by photoreceptors prepared with extruded copolyester layers of this process compared to photoreceptors prepared with copolyester layers formed by other techniques. Also, high and low contrast image printout during cycling in xerographic devices is stabilized with the copolyester layers of this process compared to photoreceptors prepared with copolyester layers formed by other techniques.

21° C. Electrical Cycle-Down (Δ $V_{DDD}$ After 50K Cycles) of Photoreceptor Devices Using Various 49000 Dry Thicknesses

| | Gravure Coating EXP. I | II | III | IV |
|---|---|---|---|---|
| RH | 500Å (0.05 μm) | 800Å (0.08 μm) | 1,500Å (0.15 μm) | 3,000Å (0.3 μm) |
| 5% | −220 | −228 | −256 | −238 Volts |
| 40% | −265 | −270 | −286 | −289 |
| | **Hand Coating W/Bird Applicator EXP. V** | **VI** | **VII** | **VIII** |
| RH | 500Å (0.05 μm) | 1,000Å (0.1 μm) | 2,000Å (0.2 μm) | 3,000Å (0.3 μm) |
| 5% | −246 Volts | −260 | −259 | −250 |
| 40% | −250 | −254 | −261 | −268 |
| | **Extrusion Coating EXP. IX** | **X** | **XI** | **XII** |
| | 600Å | 1,000Å | 1,600Å | 2,400Å |

-continued

| 21° C. Electrical Cycle-Down (Δ $V_{DDD}$ After 50K Cycles) of Photoreceptor Devices Using Various 49000 Dry Thicknesses | | | | |
|---|---|---|---|---|
| RH | (0.06 μm) | (0.1 μm) | (0.16 μm) | (0.24 μm) |
| 5% | −131 | −139 | −141 | −147 |
| 40% | −136 | −144 | −137 | −145 |

As shown in the Tables above, the overall change in dark decay (cycle down) at both high and low humidities for photoreceptors containing the extruded copolyester adhesive layer of this invention is lower than that of the photoreceptors containing copolyester adhesive layer formed by other techniques. Cycle down in undesirable because compensation for the electrical changes during cycling of the photoreceptor to maintain image quality requires constant manual adjustmenst or particularly complex and costly hardware and software. A low rate of rest recovery is achieved and less grid voltage adjustment is needed during extended machine cycling.

EXAMPLE XIV

The peel strength properties of additional photoreceptor samples prepared according to Examples I through XII were evaluated for mechanical integrity. Three photoreceptor samples [½ inch×6 inch (1.27 cm×15.24 cm)] were cut from the photorecpotor of each Example and tested for peel strength by a 180° peel measurement using an Instron Mechanical Testing Device. For each sample, peeling of the charge transport and charge generator layer combination is initiated with razor blade skiving followed by hand lifting away of a peel-strip of the other layers, i.e., anti curl back layer, substrate, silane layer and copolyester adhesive layer. The peel-strip had a length of about 3½ inches (9.0 cm). The charge transport layer side of each sample was pressed against a double-sided tape mounted on an aluminum backing plate. The edge of the free end of the sample that was separated from the peel-strip was aligned evenly with the top edge of the backing plate. The top of the backing plate was clamped in one pair jaws of the Instron Mechanical Testing Device so that the bottom end hangs downwardly. The free end of peel-strip was clamped in another pair jaws of the Instron Mechanical Testing Device with the free end being adjacent to the bottom end of the sample. When the two pairs of jaws were moved in opposite directions, the free end of peel-strip was peeled back 180° over the unpeeled segment. The load range of a Instron chart recorder was a set at a 100 gm full scale for the adhesive layer peel measurement. With the jaw crosshead speed at 1 inch/min (2.54 cm/min) and chart speed at 2 inches/min (5.08 cm/min) the peel-strip was peeled to at least 2 additional inches (5.08 cm).

A delamination test was also performed on the photoreceptor samples prepared according to Examples I through XII. The procedure for conducting the delamination test involved slitting a photoreceptor sample with a paper trimmer and the slit edge was examined for layer delamination using an optical transmission microscope at 100× magnification. The results of the peel strength and delamination tests are shown in the Tables below.

| Relationship Between 49000 Adhesive Layer Thickness and Photoreceptor Mechanical Integrity GRAVURE COATING | | | | |
|---|---|---|---|---|
| | I | II | III | IV |
| EXAMPLE | 500Å | 800Å | 1,500Å | 3,000Å |
| 180° REVERSE PEEL STRENGTH | 5.5 gm/cm | 11.5 | 26.1 | 30.8 |
| DELAMINATION AFTER SHEAR SLITTING | YES | NO | NO | NO |

| HAND COATING WITH BIRD APPLICATOR | | | | |
|---|---|---|---|---|
| | V | VI | VII | VIII |
| EXAMPLE | 500Å | 1,000Å | 2,000Å | 3,000Å |
| 180° REVERSE PEEL STRENGTH | 5.3 gm/cm | 15.2 | 28.5 | 30.2 |
| DELAMINATION AFTER SHEAR SLITTING | YES | NO | NO | NO |

| EXTRUSION COATING | | | | |
|---|---|---|---|---|
| | IX | X | XI | XII |
| EXAMPLE | 600Å | 1,000Å | 1,600Å | 2,400Å |
| 180° REVERSE PEEL STRENGTH | 8.7 | 16.9 | 30.4 | 39.4 |
| DELAMINATION AFTER SHEAR SLITTING | NO | NO | NO | NO |

The results shown in the above Tables clearly demonstrate that the extrusion deposited 49000 layer produced a peel strength approximately 1.5 to 7.3 times greater than that of the 5.5 g/cm of the 500 angstrom gravure coated control. All three coating processes demonstrated large increases in adhesion as the thickness of the 49000 copolyester adhesive layer was increased. However, the extrusion process gave superior results. Both the Gravure and Bird applicator hand coated samples showed a linear relationship between adhesion and copolyester layer thickness at thicknesses between 500 angsroms and 1,800 angstroms. Beyond 2,000 angstroms, the adhesion improvement was seen to quickly level-off and asymtopically reach a maximum value of about 30.5 gm/cm at 3,000 angstroms. In contrast, the extruded 49000 copolyester showed a nearly linear adhesion relationship in the entire experimental coating thickness range of 600 angstroms to 2,400 angstroms.

The calculated rates of adhesion increase are summarized as follows:

| Between 500 and 1,800Å | |
|---|---|
| Gravure process: | 0.0215 gm/cm per Angstrom increase |
| Bird Application process: | 0.0211 gm/cm per Angstrom increase |
| Extrusion process: | 0.0217 gm/cm per Angstrom increase |
| At 2,000Å | |
| Gravure process: | 0.0018 gm/cm per Angstrom increase |
| Bird Application process: | 0.0017 gm/cm per Angstrom increase |
| Extrusion process: | 0.0162 gm/cm per Angstrom |

-continued

| increase |
|---|

Although the rate of adhesion increase in all three processes is about equivalent for a 49000 copolyester thickness range between 500 and 1,800 angstroms, at 2,000 angstroms, the rate of adhesion increase for the extrusion process was approximately 10 times greater than that for both the gravure and Bird applicator hand coating procsses.

EXAMPLE XV

Photoreceptors were prepared as described in Example IX except that the charge transport layers were extrusion coated. The charge transport layers contained about 40 percent by weight N,N'-diphenyl-N,N'-bis(3-methylphenyl)-[1,1'-biphenyl]-4,4'-diamine. The photoreceptor belt was tested for resistance to seam delamination by cycling over rollers having a diameter of 19 mm in a xerographic imaging device utilizing corona charging, light exposure, magnetic brush development, electrostatic transfer and blade cleaning. The seams of the photoreceptor having the 0.06 micrometer thick (prior to application of subsequent coatings) duPont 49000 adhesive layer separated after 3,000 imaging cycles.

EXAMPLE XVI

A photoreceptor belt was prepared as described in Example X except that the charge transport layer was extrusion coated. The charge transport layers contained about 40 percent by weight N,N'-diphenyl-N,N'-bis(3-methylphenyl)-[1,1'-diamine. The photoreceptro belt was tested in a Xerox 1065 machine for 100,000 complete imaging cycles. No seam delamination was observed. The sample exhibited excellent electrical properties (including negligible cycle down) and produced excellent prints throughout the 100,000 complete imaging cycles.

EXAMPLE XVII

A photoreceptor sample was prepared as described in Example XI and (except that the charge transport layer was extrusion coated. The charge transport layers contained about 40 percent by weight N,N'-diphenyl-N,N'-bis(3-methylphenyl)-[1,1'-biphenyl]-4,4'diamine) tested using the procedure described in Example XVI. Good electrical stability and seam integrity of the photoreceptor belt were maintained throughout imaging cycling testing.

Although the invention has been described with reference to specific preferred embodiments, it is not intended to be limited thereto, rather those skilled in the art will recognize that variations and modifications may be made therein are within the spirit of the invention and within the scope of the claims.

What is claimed is:

1. A process for fabricating an electrophotographic imaging member comprising providing an electrically conductive layer, forming a charge blocking layer comprising an aminosilane reaction product on said electrically conductive layer, extruding a ribbon of a solution comprising a copolyester resin dissolved in at least a first solvent on said electrically conductive layer to form a wet adhesive layer on said charge blocking layer, drying said wet adhesive layer to remove substantially all of said first solvent to form a dry continuous adhesive layer comprising said adhesive polymer having a thickness between about 0.08 micrometer and about 0.3 micrometer, applying to said dry continuous adhesive layer comprising said copolyester resin a mixture comprising charge generating particles dispersed in a solution of a film forming binder polymer dissolved in at least a second solvent to form a wet charge generating layer, said binder polymer being miscible with said copolyester resin, drying said wet charge generating layer to remove substantially all of said second solvent, and applying a charge transport layer, said copolyester resing consisting essentially of a linear saturated copolyester reaction product of ethylene glycol and four diacids, said copolyester resin having the following formula:

$$\mathrm{HO}\overset{\overset{\mathrm{O}}{\|}}{\mathrm{C}}\text{-[diacid-diol]}_n\text{-OH}$$

wherein said diol is ethylene glycol, said diacids are terephthalic acid, isophthalic acid, adipic acid and azelaic acid, the mole ratio of said terephthalic acid to said isophthalic acid to said adipic acid to said azelaic acid is between about 3.5 and about 4.5 for terephthalic acid: between about 3.5 and about 4.5 for isophthalic acid: between about 0.5 and about 1.5 for adipic acid: between about 0.5 and about 1.5 for azelaic acid, the total moles of diacid being in a mole ratio of diacid to ethylene glycol in the copolyester of about 1:1, n is a number between about 250 and about 400 and the $T_g$ of said copolyester resin being between about 32° C. and about 50° C.

2. A process according to claim 1 wherein said aminosilane is also a reaction product of an amino group of said silane with —COOH or —OH end groups of said copolyester resin.

3. A process according to claim 1 wherein said diamine hole transport layer comprises from about 25 percent to about 75 percent by weight of an active transport diamine compound.

4. A process according to claim 1 wherein said solution of an copolyester resin dissolved in said first solvent has a viscosity of between about 0.19 centipoise and about 0.38 centipoise.

5. A process according to claim 1 wherein said extruding of said ribbon of said solution is through an extrusion die having an opening gap height of between about 120 micrometers and about 140 micrometers.

6. A process according to claim 1 wherein said dry continuous adhesive layer has a thickness between about 0.09 micrometer and about 0.25 micrometer.

7. A process according to claim 1 wherein said dry continuous adhesive layer has a thickness between about 0.1 micrometer and about 0.17 micrometer

8. A process according to claim 1 wherein said first solvent is a mixture of solvents.

9. A process according to claim 1 wherein said copolyester resin is soluble in said second solvent.

10. A process according to claim 9 including maintaining a continuous coating of said copolyester resin on said blocking layer while applying to said adhesive layer said charge generating particles dispersed in said solution of said binder polymer dissolved in at least said second solvent to form a wet charge generating layer and maintaining a continuous coating of said adhesive polymer on said blocking layer while drying said wet charge generating layer to remove substantially all of said second solvent.

11. A process according to claim 10 including maintaining a continuous coating of said copolyester resin on said blcoking layer while applying to said adhesive layer said charge generating particles dispersed in said solution of said binder polymer dissolved in at least said second solvent to form a wet charge generating layer which dissolves copolyester resin at the interface between said adhesive layer and said generating layer to form a polymer blend zone at said interface comprising copolyester resin, generating particles, binder polymer, and second solvent, and maintaining a continuous coating of said copolyester resin on said blocking layer while drying said wet charge generating layer and said blend zone to remove substantially all of said second solvent.

12. A process according to claim 11 wherein said blend zone has a thickness of between about 0.01 micrometer and about 0.04 micrometer.

13. A process according to claim 1 including maintaining a continuous coating of said copolyester resin on said conductive layer while applying to said applying said charge transport layer to said charge generating layer.

14. A process accrding to claim 13 wherein said charge transport layer is applied to said charge generating layer as a coating mixture of a charge transport molecule, a film forming polymer, and a solvent for said film forming polymer.

15. A process according to claim 13 wherein said copolyester resin is soluble in said solvent for said film forming polymer.

16. A process according to claim 1 whrein said adhesive layer comprises at least about 90 percent by weight of said copolyester resin based on the total weight of said adhesive layer.

17. A process according to claim 1 wherein said solution comprising said copolyester resin has a copolyester resin solids to solvent ratio of between about 0.1 and about 2.5 percent by weight solids based on total weight of said solution.

18. A process according to claim 1 wherein said solution comprising said copolyester resin has a copolyester resin solids to solvent ratio of between about 0.35 and about 2 percent by weight solids based on total weight of said solution.

19. A process according to claim 1 wherein said solution comprising said copolyester resin has a copolyester resin solids to solvent ratio of between about 0.75 and about 1.5 percent by weight solids based on total weight of said solution.

20. A process according to claim 12 wherein said hole transport layer comprises from about 25 percent to about 75 percent by weight of an active transport diamine compound.

* * * * *